US006131219A

United States Patent [19]

Roberts

[11] Patent Number: 6,131,219

[45] Date of Patent: Oct. 17, 2000

[54] INFLATABLE PILLOW

[76] Inventor: Janet H. Roberts, 1219 Choptank Ct., Colonial Heights, Va. 23834

[21] Appl. No.: 09/261,415

[22] Filed: Mar. 3, 1999

[51] Int. Cl.[7] ..... A47G 9/00

[52] U.S. Cl. ..... 5/644; 5/636; 5/655.3; 5/711

[58] Field of Search ..... 5/644, 636, 638, 5/640, 645, 654, 655.3, 490, 712, 711

[56] References Cited

U.S. PATENT DOCUMENTS

| | | | |
|---|---|---|---|
| D. 318,203 | 7/1991 | Zaghini | 5/636 X |
| D. 351,526 | 10/1994 | Tarquinio | D6/604 |
| 802,526 | 10/1905 | Russell, Jr. | 5/711 |
| 818,321 | 4/1906 | Whall | 5/711 |
| 2,295,906 | 9/1942 | Lacour | 5/636 |
| 2,728,926 | 1/1956 | Emery | 5/644 |
| 2,741,780 | 4/1956 | Kimbrig | 5/711 |
| 2,896,227 | 7/1959 | Reed | 5/644 |
| 3,283,343 | 11/1966 | Worcester | 5/644 |
| 3,298,044 | 1/1967 | Saltness et al. | 5/644 |
| 3,568,227 | 3/1971 | Dunham | 5/655.3 |
| 4,118,813 | 10/1978 | Armstrong | 5/638 |
| 4,501,034 | 2/1985 | Greenawalt | 5/644 |
| 4,724,560 | 2/1988 | Christie | 5/644 |
| 4,768,247 | 9/1988 | Beier | 5/640 |
| 4,805,603 | 2/1989 | Cumberland | 5/632 |
| 4,829,614 | 5/1989 | Harper | 5/644 |
| 4,832,007 | 5/1989 | Davis, Jr. et al. | 5/636 X |
| 4,979,249 | 12/1990 | Meade, II | 5/644 |
| 5,014,377 | 5/1991 | Dixon | 5/636 |
| 5,068,933 | 12/1991 | Sexton | 5/644 |
| 5,123,132 | 6/1992 | Dixon | 5/636 |
| 5,231,720 | 8/1993 | Benoff | 5/644 |
| 5,412,822 | 5/1995 | Kelly | 5/655.3 |
| 5,586,350 | 12/1996 | Thönnessen et al. | 5/645 X |
| 5,630,651 | 5/1997 | Fishbane | 5/644 |
| 5,642,543 | 7/1997 | Huntley | 5/640 |
| 5,642,544 | 7/1997 | Munoz | 5/644 |
| 5,708,998 | 1/1998 | Torbik | 5/636 |
| 5,771,514 | 6/1998 | Wilhoit | 5/644 |
| 5,809,597 | 9/1998 | Shaw | 5/644 X |
| 5,898,963 | 5/1999 | Larson | 5/644 |
| 6,047,425 | 4/2000 | Khazaal | 5/644 |

FOREIGN PATENT DOCUMENTS

| | | | |
|---|---|---|---|
| 36813 | 1/1970 | Australia | 5/636 |
| 2648999 | 1/1991 | France | 5/644 |
| 253238 | 6/1926 | United Kingdom | 5/655.3 |
| 2148111 | 5/1985 | United Kingdom | 5/636 |
| 2194883 | 3/1988 | United Kingdom | 5/644 |

*Primary Examiner*—Terry Lee Melius
*Assistant Examiner*—Robert G. Santos
*Attorney, Agent, or Firm*—Dennis H. Lambert

[57] ABSTRACT

An inflatable pillow has an air-impervious flexible bladder with one or more chambers therein which are inflatable to different shapes, thicknesses and firmness to conform the pillow to the requirements of different individuals. A soft cover is removably placed on the bladder to enhance the comfort and appearance of the pillow, and the cover is removable for cleaning. In one form of the invention, opposite ends of the pillow are recessed to provide clearance for the face of a person using the pillow, when the person is lying on his or her side. A cervical support portion of increased thickness and/or firmness extends along a front edge of the pillow.

22 Claims, 6 Drawing Sheets

FIG. 1
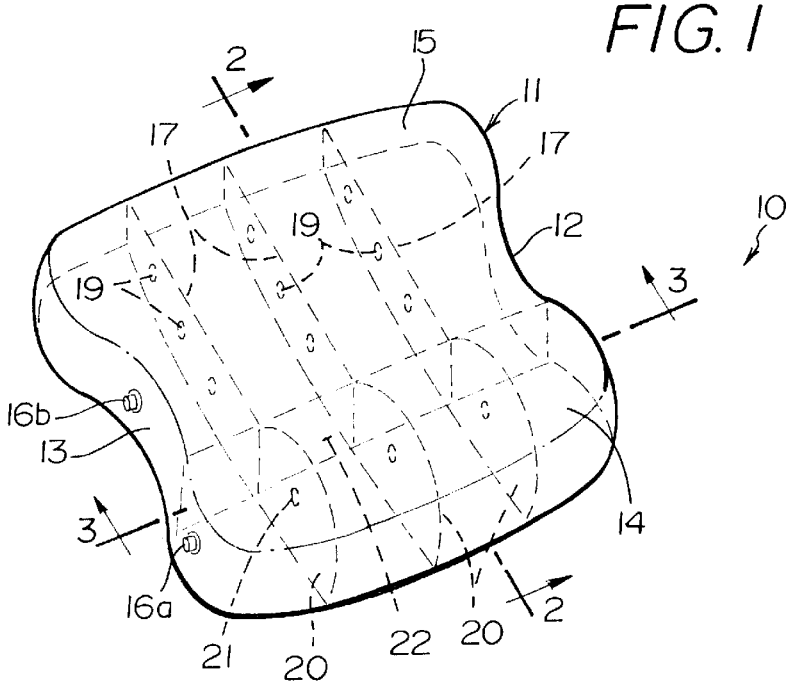
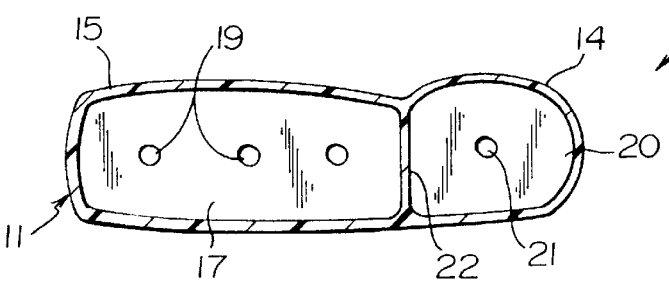
FIG. 2
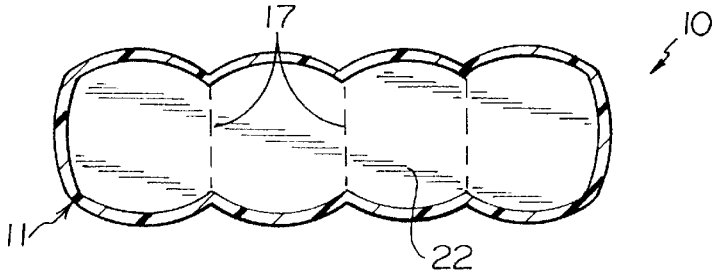
FIG. 3
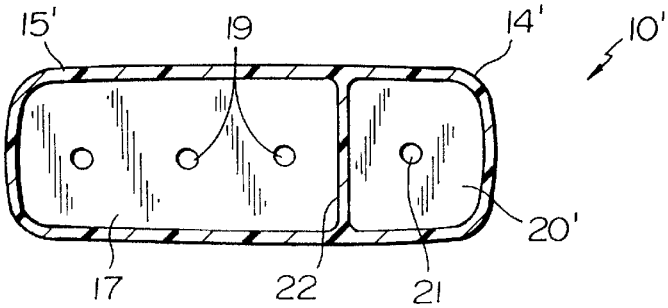
FIG. 4

FIG. 5
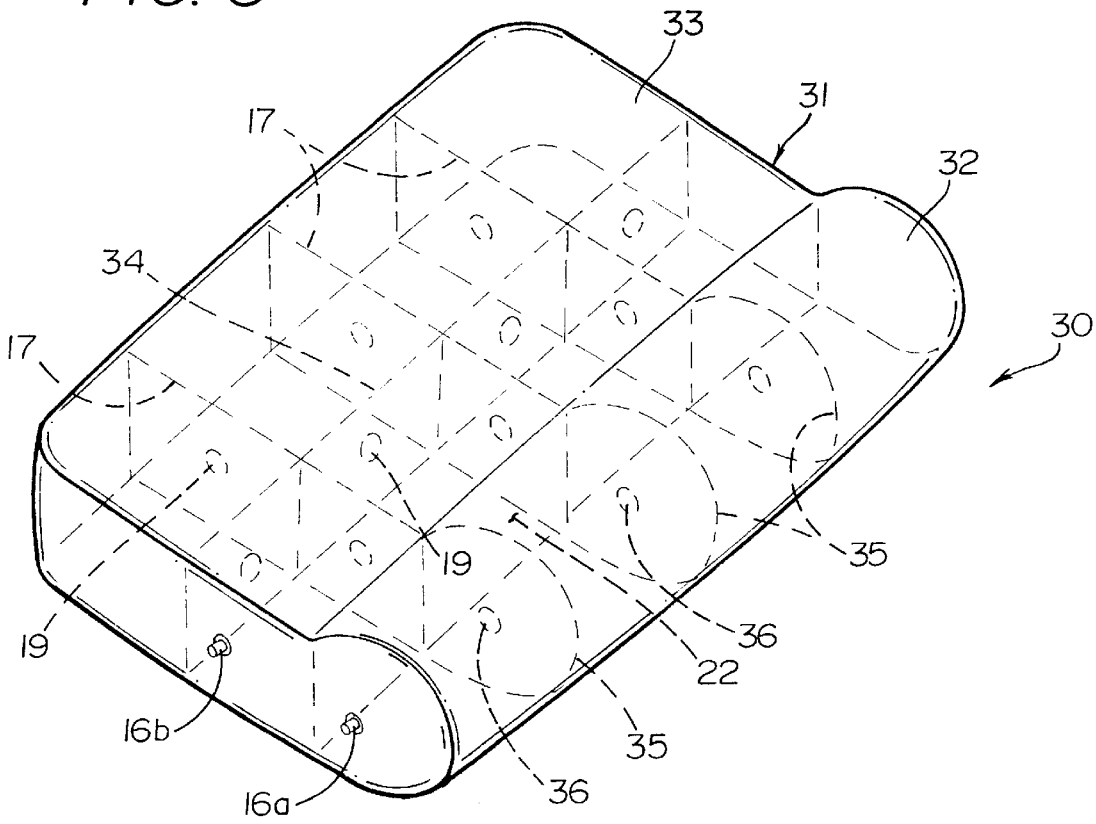
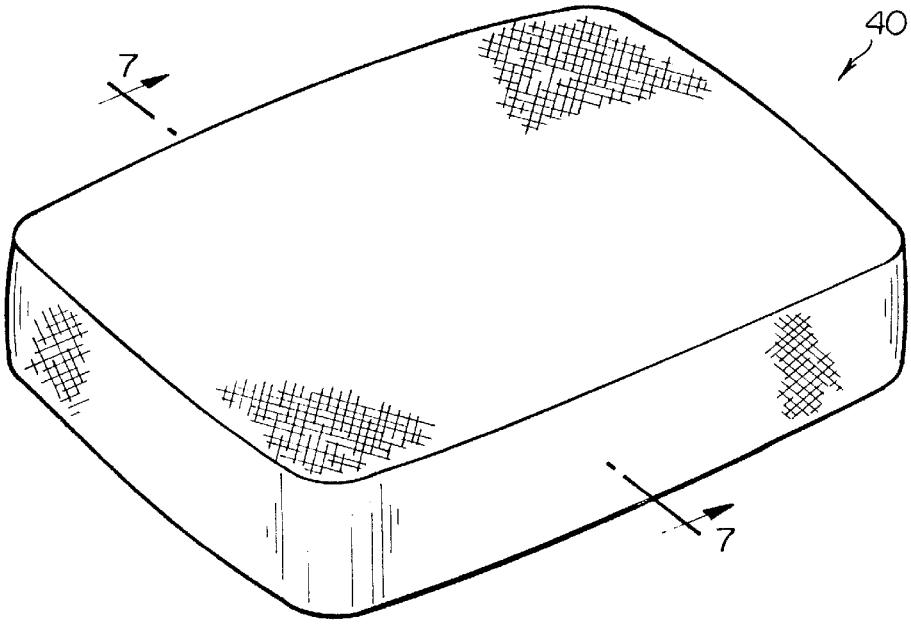
FIG. 6

FIG. 7
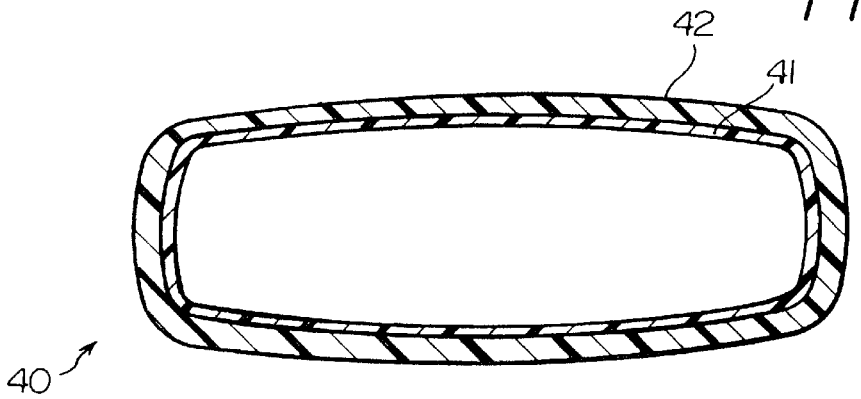
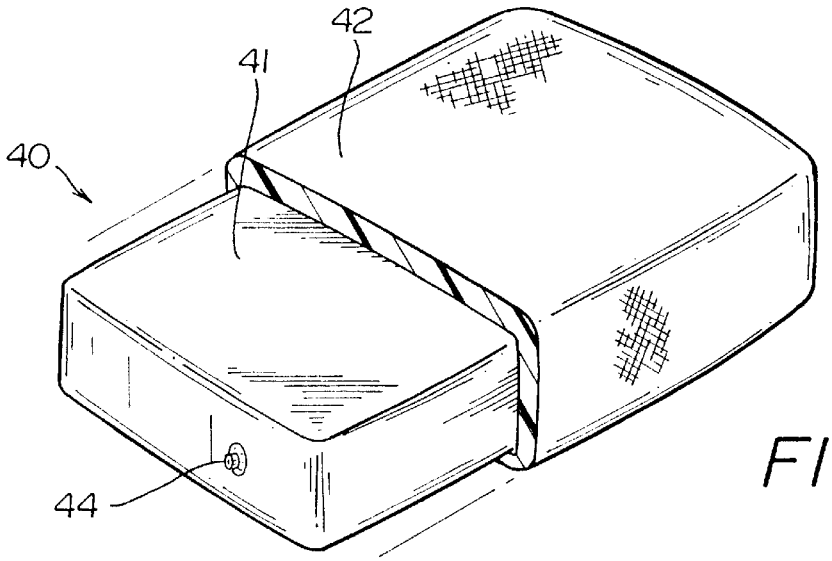
FIG. 8
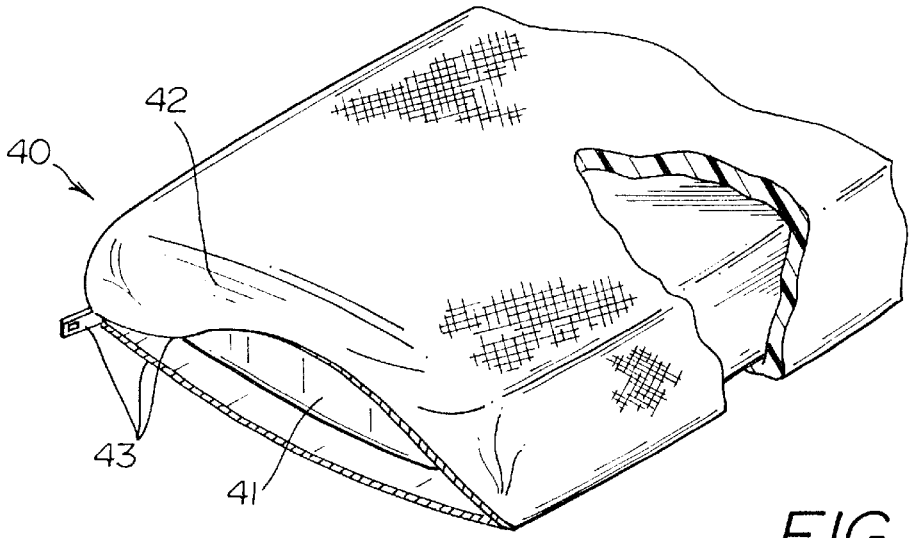
FIG. 9

INFLATABLE PILLOW

BACKGROUND OF THE INVENTION

1. Field of the Invention

This invention relates generally to pillows. More particularly, the invention relates to a pillow for supporting the head and cervical region of a person when the person is in a reclining or prone position, and especially to such a pillow which is inflatable and is capable of providing yieldable support with controllable firmness, shape and thickness, and which occupies very little space when deflated.

2. Prior Art

Proper head and cervical support is an important contributing factor to restful sleep. Inappropriate support of the head and cervical region can interfere with sleep, and cause stiffness and soreness.

Different individuals require or desire pillows of different shape and firmness.

Accordingly, there are a large number of pillows of different shape and firmness, intended to meet the different needs of many different individuals. This requires the manufacture and inventory of a large number of different pillows. Moreover, an individual may try many different pillows before finding one that is appropriate, or may never find a pillow that meets the particular requirements of that person.

For instance, some persons like a firm pillow, while others like a soft pillow. Additionally, some persons like a pillow of substantial thickness, while others prefer a relatively thin pillow. If a thick and soft pillow is used, then the user's face may become partially obstructed when the user is lying on his or her side, whereby breathing may be impaired.

Efforts have been made in the prior art to solve some of the above problems, including the manufacture of inflatable and/or shaped pillows designed to enable the user to control the firmness, shape, and/or thickness of the pillow. Other pillows have been provided with cut-outs or recessed areas to provide clearance for the face of a person when the person is lying on his or her side, whereby breathing is not impeded by the pillow. Examples of prior art inflatable and/or shaped pillows are shown in U.S. Pat. No. Des. 351,526, U.S. Pat. Nos. 2,295,906, 3,298,044, 3,568,227, 4,118,813, 4,501,034, 4,724,560, 4,805,603 and 5,642,544. U.S. Pat. Nos. 2,295,906 and 4,118,813, in particular, have cut-out portions in their opposite ends to provide clearance for the face of a person using the pillow, whereby the pillow does not impede breathing when the person is lying on his or her side. The remaining listed patents disclose pillows having inflatable chambers for varying the shape and/or firmness of support of the pillow. Most of these do not make any particular effort to provide specific support for the cervical region, and none of them provide an inflatable pillow with shaped recesses intended to provide clearance for the face of a person sleeping on his or her side, whereby breathing is not impeded.

Further, none of the prior art patents noted above discloses an inflatable pillow having an inner inflatable bladder constructed to provide a particular shape and/or areas of different firmness and thickness to a pillow, with an outer covering of soft fibrous material that may be removed for cleaning, etc.

SUMMARY OF THE INVENTION

The pillow according to the invention described herein is inflatable to varying shapes and degrees of thickness and firmness, and includes an inner inflatable bladder and an outer cover of soft fibrous material that may be removed for cleaning, etc.

In one form of the invention, the pillow has shaped recesses to provide clearance for the face of a person using the pillow so that breathing is not impeded when the person is lying on his or her side.

The pillow of the invention also includes multiple inflatable chambers that may be inflated to different degrees of firmness an/or thickness, to provide a particular support as desired by an individual. This enables fewer different pillow constructions to be manufactured and inventoried, and enables an individual to virtually custom fit a pillow to his or her particular desires or needs. Moreover, if a user selects a particular configuration, i.e., thickness and/or firmness, and that configuration does not prove to be acceptable, the user may simply reconfigure the pillow until a desired shape, thickness, and/or firmness is achieved. It is even possible for the user to adjust the configuration of the pillow while lying on it.

It is not necessary for the user to purchase a new pillow each time a different configuration is desired. Further, when the pillow is to be placed in storage, or while traveling, it may be deflated and folded or rolled to occupy a minimal amount of space.

The pillow of the invention comprises an inner air impervious bladder that may be divided into a plurality of separate cells which can be inflated to different shapes and/or degrees of firmness. Further, an outer removable covering of soft, fibrous material may be placed over the bladder for improved comfort. This cover may comprise spaced sheets of material such as cotton, or rayon, or the like, between which is a layer of soft foamed material or other synthetic material, or feathers, or the like. A zipper or other suitable fastening means at one end of the cover enables it to be applied to and removed from the inflatable bladder when desired.

A valve is associated with each separate chamber of the pillow to enable air to be introduced through the valve into the chamber to inflate it, or released through the valve to deflate the chamber. The valves may comprise valves of conventional construction such as found on inflatable air mattresses, toys, and the like.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 1 is a top perspective view of a preferred form of pillow according to the invention;

FIG. 2 is a transverse sectional view taken along line 2—2 in FIG. 1;

FIG. 3 is a longitudinal sectional view taken along line 3—3 in FIG. 1;

FIG. 4 is a transverse sectional view similar to FIG. 2, showing an alternative embodiment in which that portion of the pillow adapted to lie under the cervical region of the user is of approximately the same thickness as the remainder of the pillow;

FIG. 5 is a top perspective view of a second form of the invention, wherein the ends of the pillow ar e not recessed as in the FIG. 1 embodiment;

FIG. 6 is a top perspective view of a third form of the invention, wherein the ends are not recessed and there is no enlarged area for cervical support;

FIG. 7 is a transverse sectional view taken along line 7—7 in FIG. 6;

FIG. 8 is a somewhat schematic perspective view similar to FIG. 6, showing a portion of the covering removed;

FIG. 9 is a fragmentary perspective view of the pillow of FIGS. 6–8, showing one type of suitable fastening means that may be used to secure the covering in place on the inflatable bladder;

DESCRIPTION OF THE PREFERRED EMBODIMENTS

Figure 10:
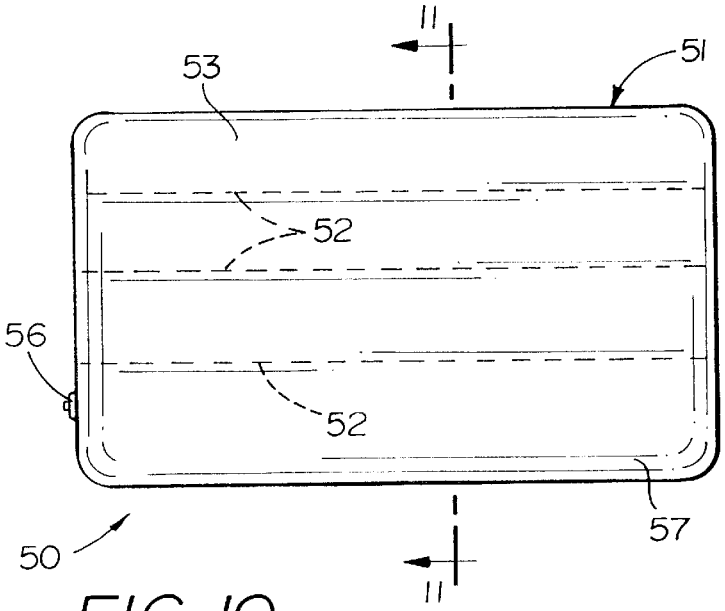
FIG. 10 is a top plan view of a fifth embodiment of the invention.

Referring more specifically to the drawings, a first form of pillow according to the invention is indicated generally at 10 in FIGS. 1–3. In this form of the invention, the pillow comprises an inflatable bladder 11 of air impervious material, having recessed areas 12 and 13 in its opposite ends to provide clearance for the face of a user lying on his or her side, and a cervical support portion 14 of increased thickness along a proximal or front side of the pillow to provide support for the cervical region of the user. The cervical support portion 14, in addition to being thicker than the body 15 of the pillow, may also be more firm than the remaining portion of the pillow, and to this end comprises a chamber separate from the chamber forming the remainder of the pillow. Separate inflation and deflation valves 16*a* and 16*b* are provided to the respective chambers.

To prevent ballooning of the pillow when it is inflated, a plurality of uniformly spaced apart tie means or restraining webs 17 extend across the interior of the body portion 15, tying the top and bottom walls of the body 15 together, as known in the art. The areas or spaces on opposite sides of the webs 17 are in communication with one another through openings 19 extended through the webs.

Similarly, the shape of the cervical support portion 14 is retained by a plurality of internal webs 20 tying the top and bottom walls of this portion together, as conventionally known. The spaces between the webs 20 are in communication with one another through openings 21 extended through the webs.

The chambers forming the cervical support portion 14 and body 15 are maintained separate from one another by an imperforate web 22 extending across the length of the pillow.

In use, the cervical support region 14 and the body of the pillow 15 may be inflated to the same firmness, or the cervical support region may be inflated to be more firm than the body 15, or the cervical support region may be only partially inflated so that it is softer and even less thick than the body 15.

When it is desired to store the pillow, the valves 16*a* and 16*b* are opened to permit the air to escape, whereby the pillow may be flattened and rolled or folded into a very compact size, thereby making it convenient to store or to carry along when traveling.

The valves 16*a* and 16*b* may be pushed into a stored position flush with the surface of the bladder when the valves are not in use, and may be pulled out to enable air to be blown through the valves or exhausted therefrom, as known in the art.

An alternate form of the pillow of FIG. 1 is indicated generally at 10' in FIG. 4. In this form, the cervical support region 14' is of the same thickness as the body 15. Correspondingly, the webs 20' extending across the interior of the cervical support region 14' are of less height than the webs 20 in the first form of the invention described above. In all other respects, this form of the invention is identical to that shown and described in relation to FIGS. 1–3.

It is to understood that the forms of the pillow thus far described are preferably provided with a covering of soft fibrous material, as described more fully hereinafter. For sake of clarity, the covering has not been shown in FIGS. 1–4.

A third embodiment of the invention is indicated generally at 30 in FIG. 5 and comprises an air impervious bladder 31 having a rounded cervical support region 32 along its proximal or front edge, and a generally flat rectangularly shaped body portion 33. This form of the invention differs from that shown in FIG. 1 primarily in that the opposite ends of the pillow are not recessed as at 12 and 13 in FIG. 1. In addition, the cervical support region 32 is slightly more rounded, and a longitudinally extending web 34 extends longitudinally across the body 33 at approximately its center, in addition to the transverse webs 17, to provide additional support to prevent ballooning of the body 33 in those areas unsecured by the webs. The spaces between the webs are in communication with one another through openings 19 in the transverse and longitudinal webs.

The chamber forming cervical support portion 32 is separated from the chamber forming the body 33 by an imperforate web 22, as in the previous form of the invention, and a plurality of support webs 35 are spaced equidistantly along the length of the cervical support portion 32 to assist in retaining the shape of the cervical support portion. Openings 36 extend through the webs 35 to provide communication between the spaces on opposite sides of the webs.

As in the previously described form of the invention, this form also has a removable covering, which has been omitted from this figure for sake of clarity. Additionally, the pillow 30 may be deflated and rolled or folded into a compact configuration for storage or travel.

A fourth embodiment of the invention is indicated generally at 40 in FIGS. 6–9, and in this form the pillow very closely resembles a conventional pillow in its shape. In this form of the invention, an air impervious inflatable bladder 41 of generally rectangular configuration is encased within an outer removable covering 42 of soft, fibrous material such as down or foamed material, etc.

The covering 42 is shaped into a tubular configuration similar to a pillow case, and has suitable fastening means at one end, such as a zipper 43, for securing the covering 42 over the bladder 41.

A valve 44 in one end of the bladder 41 may be used to inflate and deflate the bladder.

As depicted in FIGS. 6–9, the bladder 41 is completely open on its interior, and does not have any shape retaining webs therein, although such could be provided, if desired.

Figure 11:
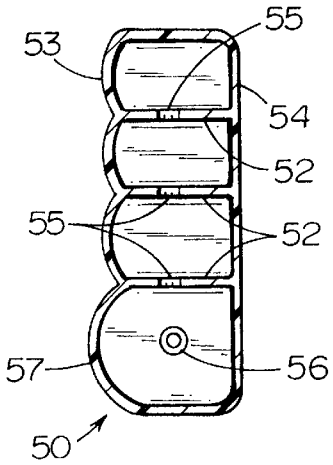
FIG. 11 is a transverse sectional view taken along line 11—11 in FIG. 10.

A fifth embodiment of the invention is indicated generally at 50 in FIGS. 10 and 11. In this form of the invention, the bladder 51 has a plurality of longitudinally extending shape retaining webs 52 therein, tying the top wall 53 to the bottom wall 54. A plurality of openings 55 extend through the webs 52 to place the spaces between the webs in communication with one another.

A valve 56 may be provided in a suitable location on the pillow for inflating and deflating it, as previously described.

As represented in FIG. 11, one longitudinal edge of the pillow may be slightly thicker than the remainder of the pillow to define a cervical support region 57 extending along one edge of the pillow. In the particular embodiment shown, the spaces between the webs 52 are in communication with one another, and the cervical support region 57 will be of the same firmness as the remainder of the pillow. However, the space under the cervical support region may be separated from the remainder of the pillow so that it may be inflated to a different firmness than the remainder of the pillow.

As in the previously described forms of the invention, this form also has a removable covering, which has been omitted from this figure for sake of clarity. Additionally, the pillow 50 may be deflated and rolled or folded into a compact configuration for storage or travel.

Figure 12:
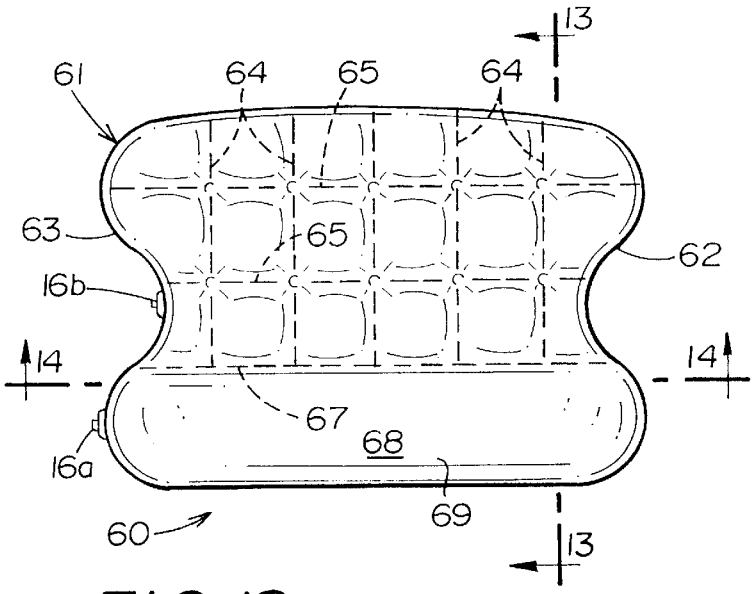
FIG. 12 is a top plan view of a sixth embodiment of the invention.
Figure 13:
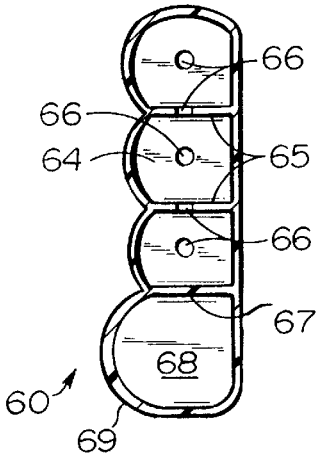
FIG. 13 is a transverse sectional view taken along line 13—13 in FIG. 12.
Figure 14:
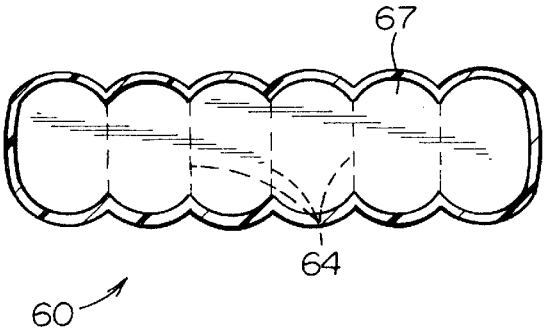
FIG. 14 is a longitudinal sectional view taken along line 14—14 in FIG. 12.

A sixth embodiment of the invention is indicated generally at 60 in FIGS. 12–14. In this embodiment, the inflatable pillow 61 has recessed opposite ends 62 and 63 as in the first embodiment described in FIG. 1, with a plurality of transverse webs 64 and longitudinal webs 65, both having openings 66 therethrough so that the spaces between the webs 64 and 65 are in communication with one another.

An imperforate, longitudinally extending web 67 separates the body of the pillow from a single, large, elongate chamber 68 at the proximal or forward edge of the pillow, defining a slightly enlarged cervical support region 69 along the front edge of the pillow.

Figure 15:
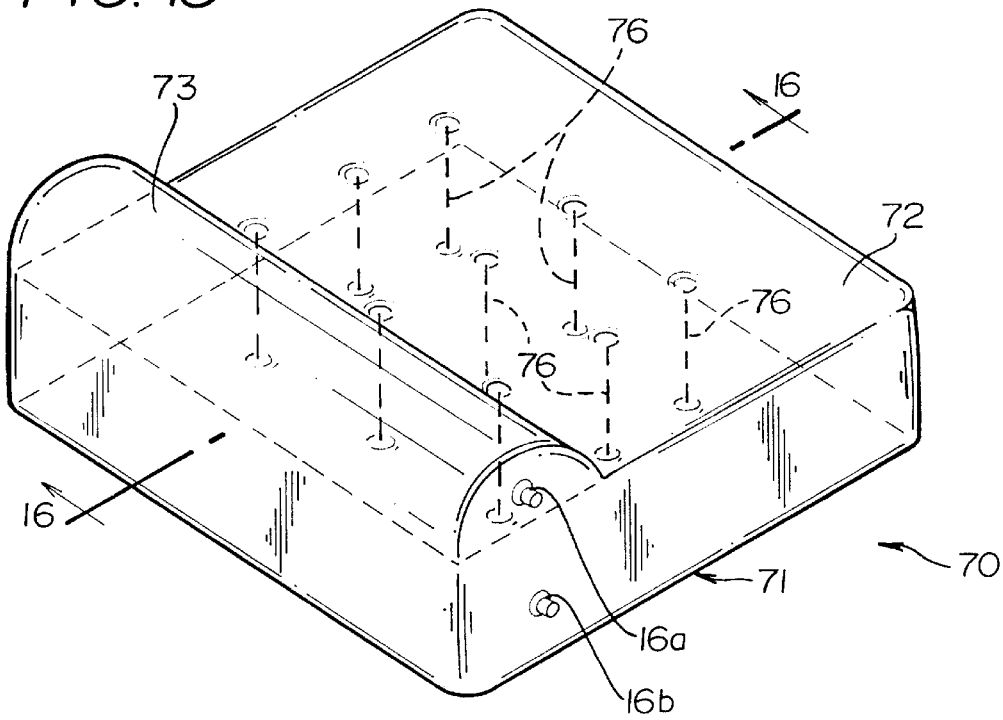
FIG. 15 is a top perspective view of a seventh embodiment of the invention.
Figure 16:
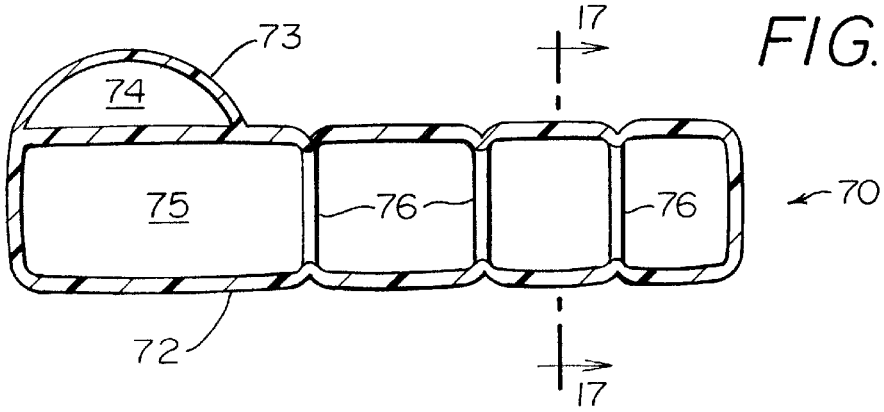
FIG. 16 is a transverse sectional view taken along 16—16 in FIG. 15.
Figure 17:
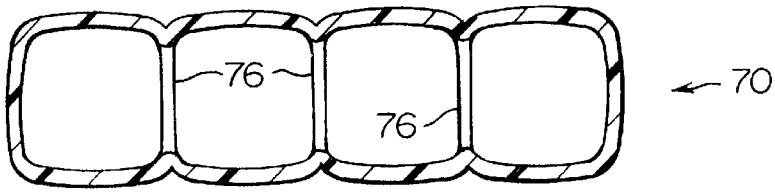
FIG. 17 is a longitudinal sectional view taken along 17—17 in FIG. 16.

A seventh embodiment of the invention is indicated generally at 70 in FIGS. 15–17. In this form of the invention, the pillow 71 comprises a rectangular body 72 with an upwardly protruding, rounded support 73 for the cervical region disposed on top of the body 72 along one edge thereof. The cervical support 73 is defined by an air chamber 74 separate from and on top of the air chamber 75 forming the pillow body. The top and bottom walls of the body 72 are held in appropriately spaced relationship by a plurality of ties 76 spaced uniformly across the body 72 and secured at their upper and lower ends to the top and bottom walls, respectively, of the body.

The chambers 74 and 75 may be independently inflated or deflated by use of the valves 15 and 16, whereby various degrees of firmness and different shapes can be obtained.

As in the previously described forms of the invention, a cover 42 may be provided on the pillow 71, although it has not been shown in these figures for sake of clarity.

Figure 18:
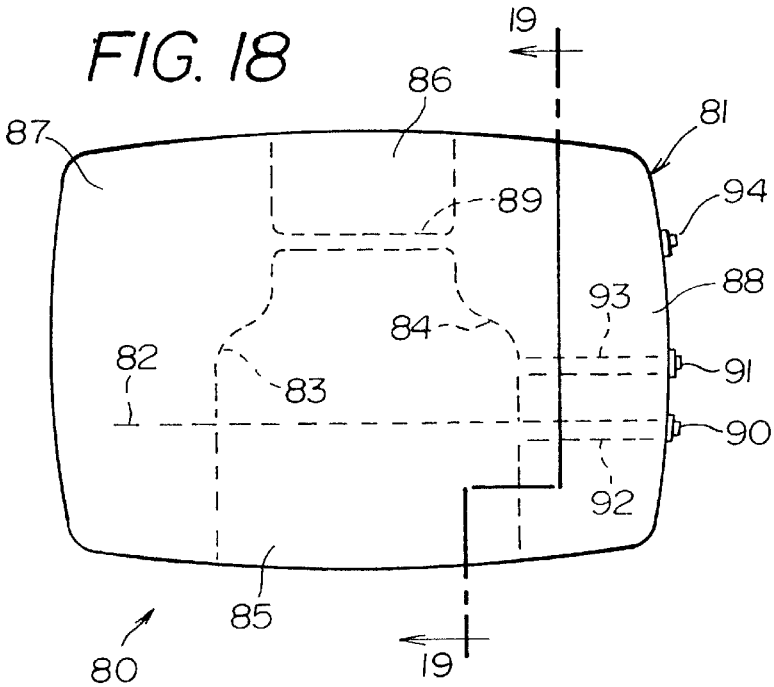
FIG. 18 is a top plan view of a eighth embodiment of the invention.
Figure 19:
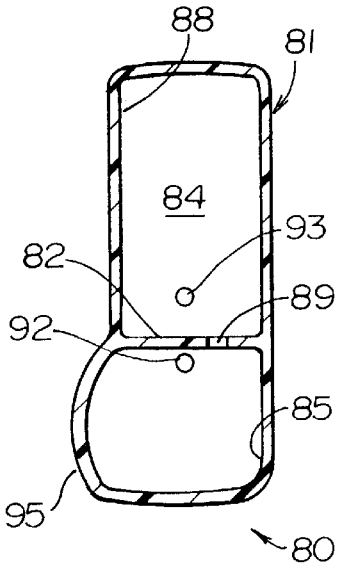
FIG. 19 is a transverse sectional view taken along line 19—19 in FIG. 18.

An eighth embodiment of the invention is indicated generally at 80 in FIGS. 18 and 19. In this form of the invention, the pillow body 81 is divided longitudinally by an imperforate web or partition 82, and divided transversely by a pair of spaced apart webs or partitions 83 and 84, which together separate the interior of the pillow 81 into a first chamber 85 at a front central portion of the pillow, a second chamber 86 extending rearwardly across the center of the pillow from the partition 82 to the rear edge of the pillow, and side chambers 87 and 88 at opposite ends of the pillow. Openings 89 through the partition 82 in the chambers 87 and 88 afford communication between the spaces on opposite sides of the partition 82. However, the spaces 85 and 86 are not in communication with one another, or with the chambers 87 and 88.

Additionally, the chambers 87 and 88 communicate with one another through a passage 89 extended between the partitions 83 and 84.

Air is introduced into the chambers 85 and 86 through respective valves 90 and 91, and associated tubular passages 92 and 93. Air is introduced into the chambers 87 and 88 through a valve 94.

It will be noted that the partitions 83 and 84 are spaced closer together toward the rear of the pillow than they are toward the front thereof. This results in a relatively longer chamber 85 at a front central portion of the pillow than across a rear width thereof. The front central portion 85 defines a cervical support 95 that may have its firmness adjusted independently of the firmness of the remaining sections of the pillow. Similarly, the central rear portion of the pillow defined by the chamber 86 may have its firmness adjusted independently of the firmness of the remaining sections of the pillow. With this arrangement, the cervical support region 95 may be made of a desired firmness, with the central rear portion of the pillow defined by chamber 86 having a different firmness, and the opposite end portions of the pillow defined by chamber 87 and 88 having yet a further degree of firmness. Of course, all of the areas of the pillow could be given the same degree of firmness, if desired.

This form of pillow enables a wide range of firmness and shape configurations to be accomplished. For instance, the cervical support region 95 defined by chamber 85 could have the greatest firmness, with the opposite end or side portions of the pillow defined by chambers 87 and 88 having a least firmness, and the central rear portion of the pillow defined by chamber 86 having an intermediate firmness, for example.

Figure 20:
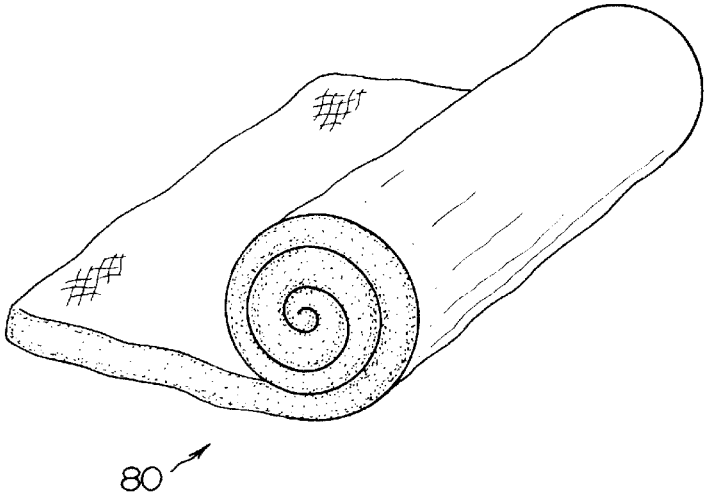
FIG. 20 is a somewhat schematic top perspective view showing how the pillow may be rolled for storage in a compact condition when it is deflated.
Figure 21:
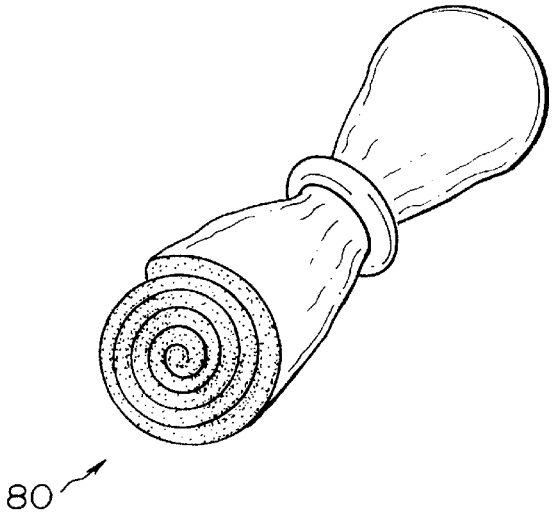
FIG. 21 is a somewhat schematic perspective view showing the pillow deflated and rolled up for storage.

FIGS. 20 and 21 simply depict the pillow 80 deflated and rolled up into a compact condition for storage and/or transportation. Although the deflated and rolled up pillow in these figures is indicated here as pillow 80, it should be understood that the same applies to any of the pillows described and illustrated herein.

While particular embodiments of the invention have been illustrated and described in detail herein, it should be understood that various changes and modifications may be made to the invention without departing from the spirit and intent of the invention as defined by the scope of the appended claims.

What is claimed is:

1. An inflatable pillow, comprising:

an air-impervious flexible bladder having spaced apart top and bottom walls, front and back longitudinal edges, opposite ends, and a web extending across an interior portion of the bladder, dividing it into a first relatively large chamber, and a second relatively smaller chamber along the front edge of the bladder, said second chamber forming a thickened cervical support portion at said front edge, said chambers being separately inflatable and contiguous to one another, at least said first chamber having a plurality of uniformly spaced apart tie means connected between the top and bottom walls; and valve means accessible exteriorly of the bladder for independently inflating and deflating the chambers.

2. An inflatable pillow as claimed in claim 1, wherein:

the opposite ends of the pillow are recessed to provide clearance for the face of a person using the pillow when the person is lying on his or her side.

3. An inflatable pillow as claimed in claim 1, wherein:

the chambers are inflatable to different firmness, thickness and shapes.

4. An inflatable pillow as claimed in claim 3, wherein:

a cervical support portion of increased thickness and/or firmness relative to the remainder of the bladder extends along the front edge thereof.

5. An inflatable pillow as claimed in claim 4, wherein:

the cervical support portion is divided into a center part and opposite side parts which are inflatable to different pressures to obtain areas of different firmness and/or thickness along the length of the cervical support portion.

6. An inflatable pillow as claimed in claim 4, wherein:

said bladder comprises a large rectangularly shaped body defining said first chamber; and the cervical support portion is formed by a separate chamber on top of the front edge of the body.

7. An inflatable pillow as claimed in claim 4, wherein:

the bladder comprises a large rectangularly shaped body; and the cervical support portion is defined by a thickened, rounded front edge on the body.

8. An inflatable pillow as claimed in claim 4, wherein:

the bladder comprises a large rectangularly shaped body, and the tie means comprise webs extending across the interior thereof.

9. An inflatable pillow as claimed in claim 8, wherein:

shape-retaining webs extend across the interior of the cervical support portion.

10. An inflatable pillow as claimed in claim 8, wherein:

the cervical support portion is defined by a single elongate chamber free of intersecting webs.

11. An inflatable pillow as claimed in claim 5, wherein:

the opposite ends of the pillow are recessed to provide clearance for the face of a person using the pillow when the person is lying on his or her side.

12. An inflatable pillow as claimed in claim 6, wherein:

the opposite ends of the pillow are recessed to provide clearance for the face of a person using the pillow when the person is lying on his or her side.

13. An inflatable pillow as claimed in claim 7, wherein:

the opposite ends of the pillow are recessed to provide clearance for the face of a person using the pillow when the person is lying on his or her side.

14. An inflatable pillow as claimed in claim 9, wherein:

the opposite ends of the pillow are recessed to provide clearance for the face of a person using the pillow when the person is lying on his or her side.

15. An inflatable pillow as claimed in claim 10, wherein:

the opposite ends of the pillow are recessed to provide clearance for the face of a person using the pillow when the person is lying on his or her side.

16. An inflatable pillow as claimed in claim 1, wherein:

a soft, padded cover is on said bladder, said cover having releasable fastening means at one end to enable the cover to be secured in enclosing relationship to the bladder, and removed therefrom when desired.

17. An inflatable pillow as claimed in claim 16, wherein:

the opposite ends of the pillow are recessed to provide clearance for the face of a person using the pillow when the person is lying on his or her side.

18. An inflatable pillow as claimed in claim 1, wherein:

the web separating the first and second chambers is imperforate; and the tie means comprises a first plurality of webs extending transversely across the first chamber, secured at top and bottom edges thereof to the top and bottom walls, respectively, of the bladder, and at opposite ends to the back edge of the bladder and to the imperforate web, respectively.

19. An inflatable pillow as claimed in claim 18, wherein:

the tie means further comprises a second plurality of webs extending transversely across the second chamber, secured at top and bottom edges thereof to the top and bottom walls, respectively, of the bladder, and at opposite ends to the front edge of the bladder and to the imperforate web, respectively, said second plurality of webs being shaped at the top edges thereof to impart a rounded shape to the top wall of the second chamber and extending across the second chamber in general alignment with the first plurality of webs that extend across the first chamber.

20. An inflatable pillow as claimed in claim 19, wherein:

the tie means further comprises a longitudinally extending web intersecting with said transverse webs in said first chamber.

21. An inflatable pillow as claimed in claim 17, wherein:

the tie means comprises a plurality of webs extending longitudinally across the first chamber parallel to the front edge, secured at top and bottom edges thereof to the top and bottom walls, respectively, of the bladder, and at opposite ends to the opposite ends of the bladder.

22. An inflatable pillow as claimed in claim 17, wherein:

the tie means comprises a plurality of transverse and longitudinal intersecting webs in the first chamber, secured at top and bottom edges thereof to the top and bottom walls, respectively, of the bladder, the points of intersection of the transverse and longitudinal webs having a reduced height so that a dimpling effect is imparted to the top wall of the bladder.

* * * * *